US011318700B2

(12) United States Patent
Hagestedt

(10) Patent No.: US 11,318,700 B2
(45) Date of Patent: May 3, 2022

(54) DEVICE OF PROVIDING CUSHIONING MATERTAL FOR PACKAGING PURPOSES

(71) Applicant: Storopack Hans Reichenecker GMBH, Metzingen (DE)

(72) Inventor: Lukas Hagestedt, Esslingen (DE)

(73) Assignee: Storopack Hans Reichenecker GMBH, Metzingen (DE)

( * ) Notice: Subject to any disclaimer, the term of this patent is extended or adjusted under 35 U.S.C. 154(b) by 83 days.

(21) Appl. No.: 16/625,121

(22) PCT Filed: Jun. 21, 2018

(86) PCT No.: PCT/EP2018/066595
§ 371 (c)(1),
(2) Date: Mar. 16, 2020

(87) PCT Pub. No.: WO2019/002090
PCT Pub. Date: Jan. 3, 2019

(65) Prior Publication Data

US 2020/0207050 A1 Jul. 2, 2020

(30) Foreign Application Priority Data

Jun. 28, 2017 (DE) ..... 10 2017 114 340.8

(51) Int. Cl.
*B31D 5/00* (2017.01)
*B65B 55/20* (2006.01)
*B65D 81/03* (2006.01)

(52) U.S. Cl.
CPC ..... *B31D 5/0047* (2013.01); *B65B 55/20* (2013.01); *B31D 2205/007* (2013.01);
(Continued)

(58) Field of Classification Search
CPC ..... B31D 5/0047; B31D 2205/0023; B31D 2205/0047; B31D 2205/007;
(Continued)

(56) References Cited

U.S. PATENT DOCUMENTS 2,718,105 A * 9/1955 Ferguson ..... B29C 51/445 53/548
5,906,569 A 5/1999 Ratzel
(Continued)

FOREIGN PATENT DOCUMENTS

EP 3 064 344 A1 9/2016

OTHER PUBLICATIONS

PCT/EP2018/066595 International Search Report (translation) dated Sep. 10, 2018.

*Primary Examiner* — Sameh Tawfik
(74) *Attorney, Agent, or Firm* — Wood Herron & Evans LLP

(57) ABSTRACT

The invention relates to a device which is used to provide cushioning material for packaging purposes. The device comprises a container for storing the cushioning material and a dispensing device for dispensing the cushioning material out of the container. The dispensing device comprises a driven conveyor for conveying the cushioning material along a conveyor path, the conveyor being supported on a movable base which can be moved out of an operating position into a release position and back, said conveyor being moved out of the conveyor path in the release position.

10 Claims, 4 Drawing Sheets

Figure 1:
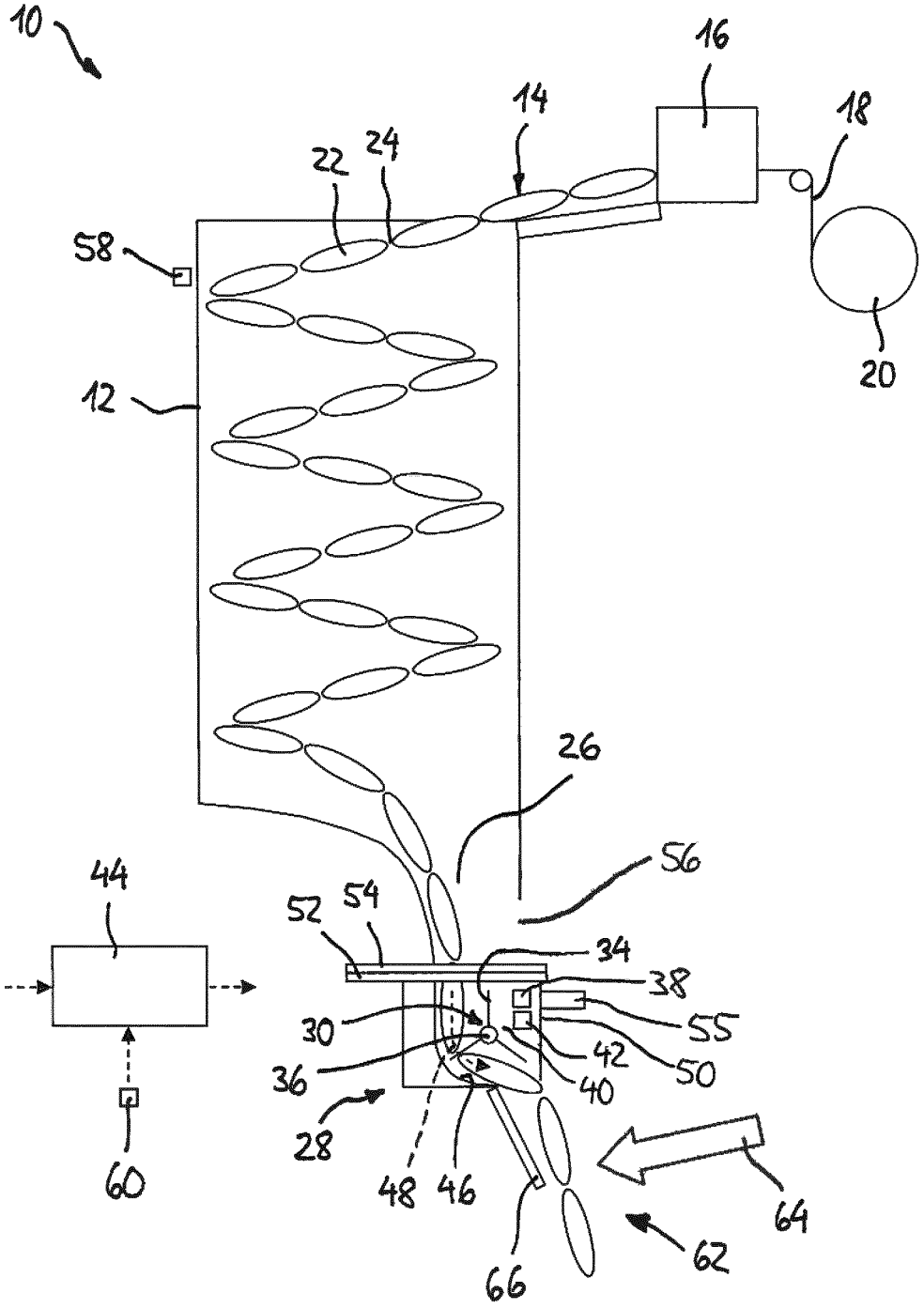

(52) U.S. Cl.
CPC ..... *B31D 2205/0023* (2013.01); *B31D 2205/0047* (2013.01); *B31D 2205/0082* (2013.01); *B31D 2205/0088* (2013.01); *B65D 81/03* (2013.01)

(58) Field of Classification Search
CPC .... B31D 2205/0082; B31D 2205/0088; B31D 81/03; B65B 55/20
USPC ..... 493/464
See application file for complete search history.

(56) References Cited

U.S. PATENT DOCUMENTS 6,179,765 B1 * 1/2001 Toth ..... B26D 7/24 493/360
7,429,304 B2 * 9/2008 McNamara, Jr ..... B31D 5/0073 156/145
7,788,884 B2 * 9/2010 Cheich ..... B65B 55/20 53/472
8,435,165 B2 * 5/2013 Bock ..... B31D 5/0047 493/405
9,694,555 B2 * 7/2017 Wetsch ..... B31D 5/006
10,286,617 B2 * 5/2019 Murch ..... B31D 5/0073
2009/0075800 A1 * 3/2009 Wetsch ..... B31D 5/006 493/464
2009/0308965 A1 * 12/2009 Piucci ..... B26D 5/20 242/526
2010/0127112 A1 5/2010 Aquarius
2011/0053743 A1 * 3/2011 Wetsch ..... B31D 5/006 493/29
2012/0053040 A1 3/2012 Wetsch et al.
2012/0072016 A1 * 3/2012 Sperry ..... B31D 5/0073 700/231
2015/0060510 A1 * 3/2015 Wetsch ..... B31D 5/0073 226/6
2018/0127136 A1 * 5/2018 Hagestedt ..... B31D 5/0073

* cited by examiner

DEVICE OF PROVIDING CUSHIONING MATERTAL FOR PACKAGING PURPOSES

The invention relates to a device for providing cushioning material for packaging purposes according to the preamble of claim 1.

EP 3 064 344 discloses a cushion converting device with which a cushioning material made of air-filled bags ("air bags") can be produced from a web-form starting material. Although not disclosed there, it is known in the marketplace to store the air-filled bags in a container and to provide a dispensing device with which the air bags can be dispensed from the container. In the known device, the dispensing device consists simply of an opening in which the user grips with his hands to retrieve the air bag. He can separate the required amount of air bags from the rest at the prefabricated perforations.

Based on this prior art, the present invention has the object of providing a device of the type mentioned at the outset which works very efficiently.

This problem is solved by a device having the features of claim 1. Advantageous further developments of the invention are specified in subclaims. In addition, the invention discloses essential features also in the following description as well as in the accompanying drawings. These features may be essential for the invention, both alone and in different combinations, without being referred to here again in detail.

According to the invention, a device is proposed for providing cushioning material for packaging purposes with a container for storing the cushioning material and a dispensing device for dispensing the cushioning material from the container. The dispensing device comprises a driven conveyor for conveying the cushioning material along a conveying path. The conveyor is held on a movable base, which can be moved from an operating position to a release position and back. In the release position, the conveyor is moved out of the conveying path.

By virtue of the measures according to the invention, the cushioning material no longer has to be taken out of the container by hand, rather, it is provided to the user by means of a motor by the dispensing device with the driven conveyor. This saves the user time, so that its overall productivity is improved. In addition, the user saves energy and he has to move less, so that the activity is less strenuous.

The fact that the base can be moved with the conveyor into a release position in which the conveyor is moved out of the conveying path, makes it so the device can be put into operation very easily and quickly. This makes it possible, in fact, for the user to reach by hand into the conveying path released by the conveyor and to pull out a cushioning material stored, for example, as endless material in the container. If the base is then moved back into the operating position with the conveyor, it is possible to start immediately with the conveyance of the cushioning material, which is now in the conveying path.

In a first further development, it is proposed that the base can be moved from the operating position into the release position and back in a translational and/or rotational manner. A translational movement is conceivable, for example, if the base is designed in the manner of a drawer. This can be achieved simply by means of a linear motion guide, for example a simple sliding guide. A rotational movement can be realized for example in the form of a pivoting about an axis of rotation, by which the base together with the conveyor is pivoted out of the conveying path. This too is easy and inexpensive.

It is particularly advantageous if the conveyor is designed in such a way that a predetermined amount of cushioning material is dispensed. This greatly simplifies and speeds up the user's work as he no longer has to estimate the amount of cushioning means he is to remove.

In a further development, it is proposed that the conveyor comprises a driven paddle wheel having a plurality of radially projecting blade sections, the space present between two adjacent blade sections being dimensioned such that a defined amount of cushioning material can be accommodated therein. A rotation of the paddle wheel enables a conveyance in the direction of rotation in particular of the cushioning pads forming the cushioning material, even if they are still connected as a strand. This is an easy way to adjust the amount of cushioning material dispensed, especially with such a cushioning material formed by individual cushioning pads.

Advantageously, the cushioning pads and the spaces between adjacent blade sections are dimensioned such that a cushioning pad fits into a space between two adjacent blade sections. At the output of the dispensing device, the cushioning material is then conveyed downward, for example, by gravitational force. There, the cushioning material can then be removed by the user after the paddle wheel comes to a standstill.

In another further development for this purpose, it is proposed that it further comprises: a detection device which detects a passing movement of a blade section, and a control device, which controls a drive of the conveyor as a function of the signal of the detection device. By way of example, an inductive sensor which emits a pulse-type signal when a blade section moves past can be used as the detection device. By means of this detection device, it is possible to count the number of blade sections moving past the detection device during a rotation of the blade wheel and in this way determine the amount of cushioning material conveyed and thus dispensed. By means of the control device, it is then possible, for example, to stop the rotation of the paddle wheel after reaching a predetermined number, which can be freely selected by the user, and thus to dispense a desired amount of cushioning material, for example a desired number of cushioning pads.

A further development is characterized in that the device also comprises: a detection device, which detects at least one request for dispensing a preferably predetermined amount of cushioning material, and a control device, which controls a drive of the conveyor as a function of the signal of the detection device. In particular, the term "detection device" is to be understood very broadly here. For example, the detection device can generally comprise an HMI interface, for example a touch screen, a screen with buttons or a keyboard, or a foot switch. By way of example, the user can enter the desired amount of cushioning material and/or initiate the dispensing of the cushioning material via the touchscreen or the screen with buttons or a keyboard. It is also possible that only the desired amount of cushioning material is entered via the touch screen or the screen with buttons or a keyboard, but the dispensing of the cushioning material is caused, for example, by the aforementioned foot switch. It is also possible that the amount of the dispensed cushioning material is adjusted by the foot switch, namely by the duration that the foot switch is pressed by the user. However, the detection device can also be a system interface to a higher-level system, for example to a Warehouse Management System (WMS), which specifies the amount of cushioning material to be dispensed based on a space present in a packaging container, or to a barcode scanner or a measurement system, which immediately detects the empty space present in a packaging container.

It is also proposed that the device comprise a cushion converting device which converts a web-form starting material into the cushioning material and dispenses the cushioning material into the container. Thus, the cushioning material is produced directly in the container, whereby the device can be operated over a relatively long period without interruption.

The invention also includes that the device further comprises: a detection device which detects a degree of filling of the container with cushioning material, and a control device which controls the cushion converting device as a function of the signal of the detection device. Thus, new cushioning material is automatically reproduced and dispensed into the container if the degree of the container falls below a predetermined limit. This prevents overfilling of the container with cushioning material.

The device according to the invention is particularly advantageous when the cushioning material comprises interconnected and separable air bags.

A further development provides that the container immediately adjacent to the dispensing device has an opening through which a user can reach into the interior of the container. In this way, the threading of the cushioning material into the dispensing device can be additionally supported.

Figure 2:
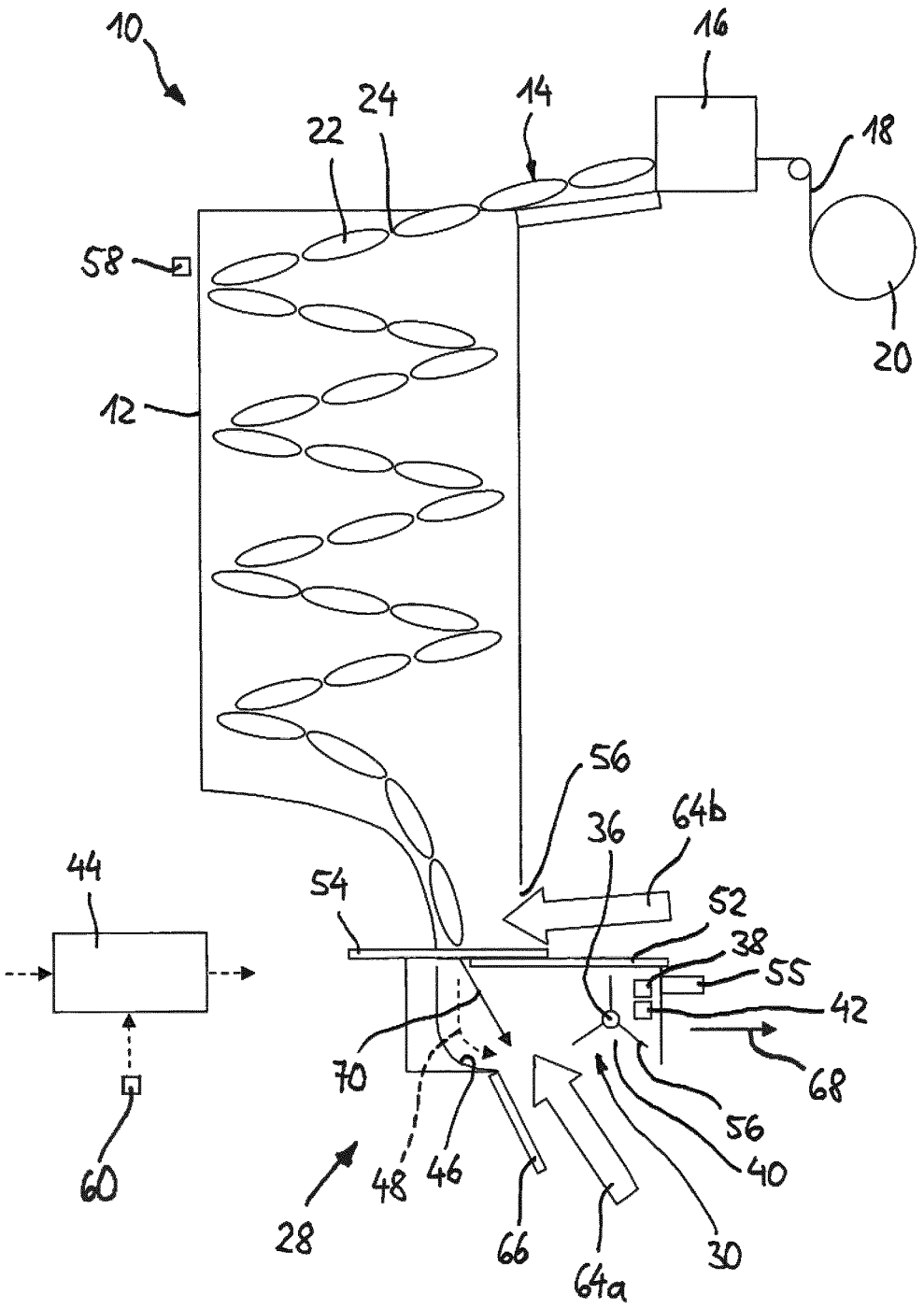
Figure 3:
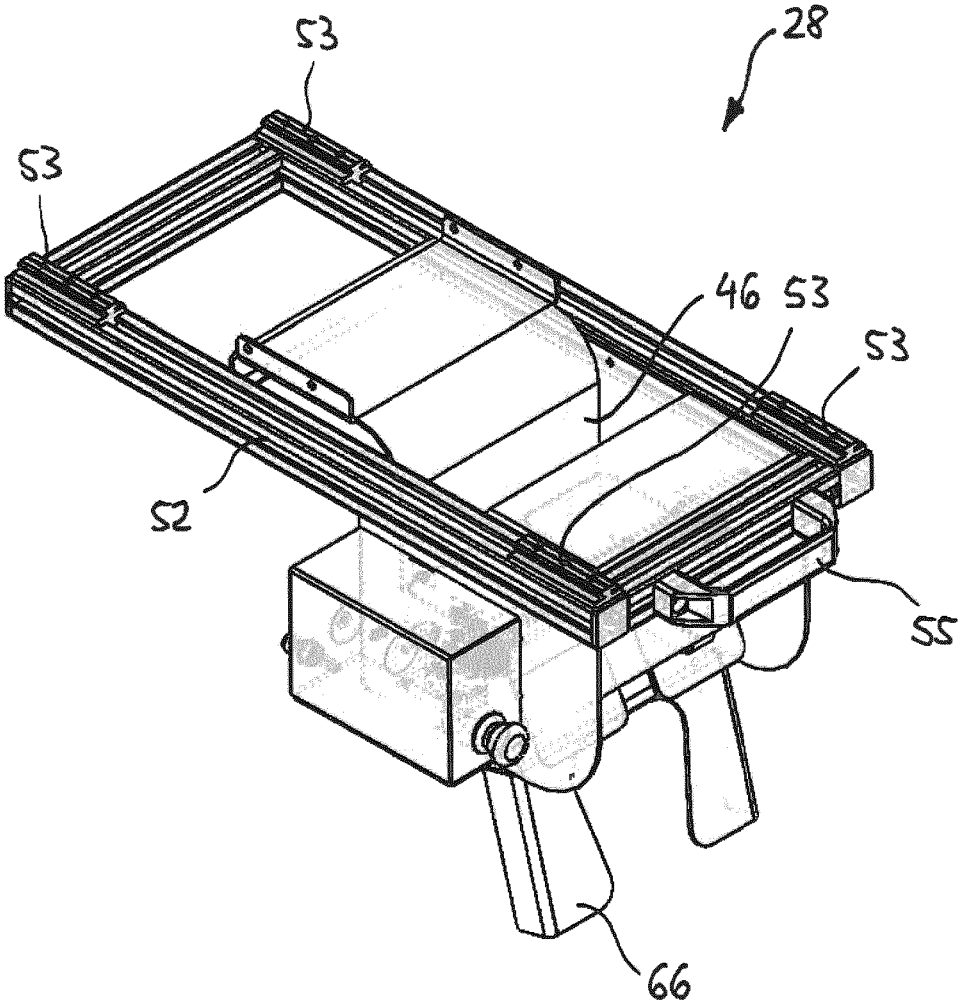
Figure 4:
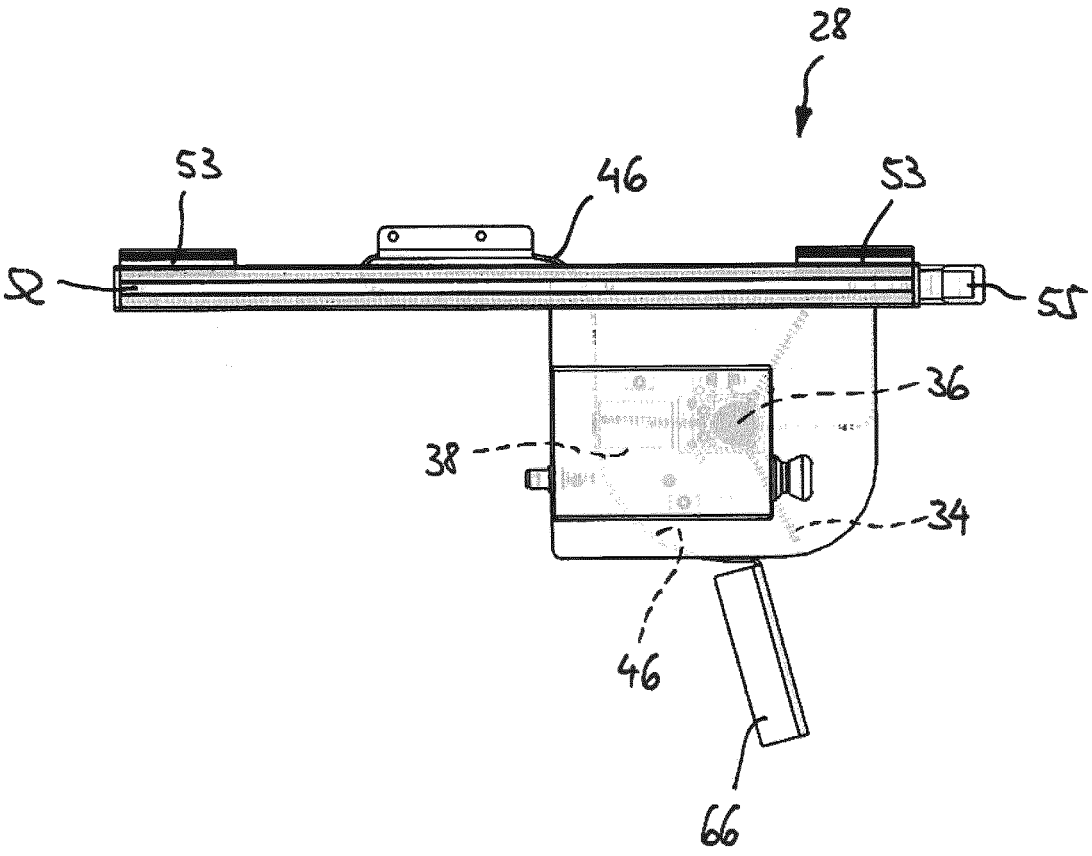

An embodiment of the invention will be explained below with reference to the drawings. The drawing shows in:

FIG. 1 a schematic view of a device for providing cushioning material for packaging purposes with a container and a dispensing device, a base of the dispensing device being in an operating position;

FIG. 2 a schematic view similar to FIG. 1, the base of the dispensing device being in a release position;

FIG. 3 a perspective view of the dispensing device of FIGS. 1 and 2; and FIG. 4 a side view of the dispensing device of FIG. 3.

A device for providing cushioning material for packaging purposes generally bears the reference numeral 10 in the figures. The device comprises a container 12 for storing cushioning material 14. In the present case, the cushioning material 14 is produced by a cushion converting device 16 from a web-form starting material 18. The web-form starting material 18 is stored on a roll 20.

In the present case, the cushioning material 14, which is stored in the container 12 and manufactured by the cushion converting device 16, is interconnected and separable air bags 22. For reasons of clarity, only one such air bag is provided with a reference numeral in FIGS. 1 and 2. The web-form starting material 18 is a plastic film tube. In the cushion converting device 16, individual chambers are separated in the film tube by a weld, filled with air and finally sealed. In this way, an endless strand of interconnected air bags 22 is generated.

Between two adjacent air bags 22 there is a perforation line 24, by which a user can separate one or more air bags 22 from the endless line, as will be explained in greater detail below. Single or multiple separate air bags 22, as will also be explained in more detail below, form cushioning pads to fill a void in a packaging container.

It is understood that in principle, other types of cushioning material are also conceivable. For example, individual cushioning pads could also be made from crumpled paper in the cushion converting device.

The container 12 has a funnel-shaped cross-sectional taper 26 at its lower end in FIGS. 1 and 2 which leads to a dispensing device 28. This comprises a driven conveyor 30 in the form of a paddle wheel with three radially projecting blade sections 34 that are arranged evenly distributed around the circumference of the paddle wheel 30 only one of which, for the sake of clarity, is provided with a reference numeral. The blade sections 34 may be made, for example, of metal or of plastic, in particular of a hard rubber material. The blade sections 34 are mounted on a shaft 36, for example a hexagonal shaft. This can in turn be rotated by means of a drive, in the present case an electric motor 38.

A space 40 present between two adjacent blade sections 34 is dimensioned such that exactly one single air bag 22 can be accommodated within it. The dispensing device 28 further comprises a detection device in the form of an inductive sensor 42, which detects a passing movement of a blade section 34. The inductive sensor 42 supplies a signal to a control device 44, which in turn drives the electric motor 38 in a manner to be explained in more detail.

The dispensing device also includes a guide sheet plate 46, which, however, despite the use of the term "sheet plate" is not necessarily made of metal, but instead may also be made of plastic. The guide sheet plate 46 extends straight downward in an upper area and encloses a quarter circumference of the paddle wheel 30 substantially concentrically in a lower area. In this way, a conveying path 48 is formed between the guide sheet plate 46 and the shaft 36 of the paddle wheel 30 and is symbolized here by a dashed arrow.

The guide sheet plate 46 is stationary relative to the container 12, so it cannot be moved relative to the container 12. By contrast, the paddle wheel 30, the electric motor 38 and the inductive sensor 42 are held on a base 50 that is movable relative to the container 12 and includes a housing which is not visible in FIGS. 1 and 2 and extends parallel to the plane of FIGS. 1 and 2. For this purpose, the housing is mounted on profiles 52, which are slidably mounted on counter profiles 54 by means of slides 53 shown only in FIGS. 3 and 4, the counter profiles 54 being fixedly mounted on the container 12.

In this way, the movable base 50 can be translationally moved via a handle 55 together with the paddle wheel 30, the electric motor 38 and the inductive sensor 42 from an operating position shown in FIG. 1 to a release position shown in FIG. 2, as well as in the opposite direction. It can be seen from FIG. 2 that in the release position shown there the conveyor 30 is moved out of the conveying path 48.

It is understood that, instead of a translational movement of the base, a rotational movement or a combination of these two movements is also possible. For example, the base at its top right in FIGS. 1 and 2 could be pivotally connected to the stationary counter-profile about a pivot axis, so that the base would be pivoted counterclockwise out of the conveying path.

The container 12 has an opening 56 immediately adjacent to the dispensing device 28. Further, in the upper region of the container 12, a detection device 58 is present, for example in the form of a light barrier, which detects a degree of filling of the container 12 with cushioning material 14. The detection device 58 is also connected to the control device 44. The control device 44 in turn controls the cushion converting device 16 as a function of the signal of the detection device 58.

Finally, the device 10 also includes a detection device 60, which in the present case is designed as a touchscreen. In embodiments not shown, the detection device 60 could also be a screen with buttons and/or a keyboard, or an interface with a Warehouse Management System (WMS), a barcode scanner or a sensor that detects the degree of filling in a packaging container. In the present case, the user can, on the one hand, enter via the detection device 60 the number of air bags 22 to be dispensed in a request and, on the other hand, can enter a request command, which triggers the dispensing of the desired number of air bags 22.

The device shown in FIGS. 1 and 2 operates as follows: in operation, the movable base 50 is in its operating position shown in FIG. 1. From the cushion converting device 16, an endless strand of cushioning material 14 formed by continuous air bags 22 is produced and dispensed into the container 12. When the detection device 58 detects that the filling degree of the container 12 reaches or exceeds a predetermined limit value, the cushion converting device 16 is stopped via the control device 44. If the degree of filling of the container 12 drops back below the predetermined limit value, the cushion converting device 16 is again controlled by the control device 44 in such a way that it produces new cushioning material into the container 12.

In order to obtain a desired number of air bags 22, the user makes the corresponding input at the detection device 60, and further presses at the detection device 60 the button which causes a dispensing of the desired quantity of air bags 22. This quantity given here as an example is 2. The controller 44 then drives the electric motor 38, so that the paddle wheel 30 rotates counterclockwise.

A signal is then output from the inductive sensor 42 to the control device 44 every time a blade section 34 passes the inductive sensor 42. After two such signals, the electric motor 38 is stopped by the control device 44. Since the space 40 between two adjacent blade sections 34 is dimensioned so that exactly one single air bag 22 fits into it, it can be assumed that exactly two air bags 22 were conveyed along the conveying path 48 into an exit region 62 below the dispensing device 28.

The user can now reach with his hand, which is indicated here by an arrow 64, into the perforation line 24 above the two air bags 22 and disconnect the two air bags 22 suspended by gravity from the remainder still in the dispensing device 28. For this purpose, the dispensing device 28 has a slotted counter-plate 66, which is shown in detail in FIG. 3.

For various reasons, a situation may occur in which the endless strand of the cushioning material 14 does not reach into the dispensing device 28. This is typically the case when a new roll 20 of web-form starting material 18 has been used. The user now has the task of threading the endless strand of the cushioning material 14 into the dispensing device 28. For this purpose, as shown in FIG. 2, he pulls the movable base 50 in the direction of the arrow 68 into the release position shown in FIG. 2 by means of the handle 55 in FIG. 2. As a result, the conveyor 30, i.e. the paddle wheel 30 with the electric motor 38 and the inductive sensor 42, are moved away from the guide sheet plate 46 and thus out of the conveying path 48.

The user can now, as indicated by the arrow 64*a*, reach into the conveying path 48 from below, grab the lower end of the endless strand of the cushioning material 14 and pull down along the arrow 70. This may in some cases also be supported by the user reaching with the other hand through the opening 56 into the interior of the container 12, which is indicated by the arrow 64*b*. Then the user pushes the base 50 from the release position shown in FIG. 2 back into the operating position shown in FIG. 1, so that normal operation of the device 10 can then be started as described above in connection with FIG. 1 by way of example.

The invention claimed is:

1. A device for providing cushioning material for packaging, comprising:

a container for storing the cushioning material, a dispensing device for dispensing the cushioning material from the container, the dispensing device positioned below the container, the dispensing device comprising a driven conveyor in the form of a paddle wheel having a plurality of radially projecting blade sections for conveying the cushioning material along a conveying path, the paddle wheel draws the cushioning material downwardly and out of the container, the conveyor being held on a movable base which can be moved from an operating position into a release position and vice versa, the conveyor in the release position being moved out of the conveying path, and a guide sheet plate positioned below the container and adjacent to the dispensing device, the guide sheet plate having an upper portion which extends vertically downward and a lower portion which substantially concentrically encloses a quarter circumference of the paddle wheel, the conveying path being formed between the guide sheet plate and a shaft of the paddle wheel.

2. The device according to claim 1, wherein the base can be moved translationally and/or rotationally from the operating position into the release position and back.

3. The device according to claim 2, wherein it further comprises: a detection device which detects a passing movement of a blade section, and a control device which controls a drive of the conveyor as a function of the signal of the detection device.

4. The device according to claim 1, further comprising a detection device detecting at least one request for dispensing a preferably predetermined amount of cushioning material and a control device which controls a drive of the conveyor as a function of the signal of the detection device.

5. The device according to claim 1, further comprising a cushion converting device which converts a web-form starting material into the cushioning material and dispenses the cushioning material into the container.

6. The device according to claim 5, wherein it further comprises: a detection device which detects a degree of filling of the container with cushioning material, and a control device which controls the cushion converting device as a function of the signal of the detection device.

7. The device according to claim 1, wherein the cushioning material comprises interconnected and separable air bags.

8. The device according to claim 1, wherein the container has an opening adjacent to the dispensing device through which a user can reach into the interior of the container.

9. The dispensing device according to claim 1, wherein a space is defined between two adjacent blade sections that is dimensioned such that one single air bag can be accommodated within the space.

10. The dispensing device according to claim 1, further comprising a slotted plate extending downwardly from the lower portion of the guide sheet plate, the slotted plate having a slot extending upwardly from a lower edge of the slotted plate, the slot including an open mouth at the lower edge of the slotted plate.

* * * * *